US007219602B2

(12) United States Patent
Geise

(10) Patent No.: US 7,219,602 B2
(45) Date of Patent: May 22, 2007

(54) CAN COLLECTION CATCH BIN FOR USE WITH ALUMINUM CAN COMPACTING MECHANISM

(76) Inventor: Gregory D. Geise, W.127 N.6541 Blue Spruce Ct., Menomonee Falls, WI (US) 53051

( * ) Notice: Subject to any disclaimer, the term of this patent is extended or adjusted under 35 U.S.C. 154(b) by 0 days.

(21) Appl. No.: 10/959,728

(22) Filed: Oct. 6, 2004

(65) Prior Publication Data

US 2006/0021525 A1 Feb. 2, 2006

Related U.S. Application Data

(60) Provisional application No. 60/591,671, filed on Jul. 28, 2004.

(51) Int. Cl.
*B30B 1/04* (2006.01)
*B65D 25/10* (2006.01)
*B30B 9/32* (2006.01)

(52) U.S. Cl. ..... 100/227; 100/258 A; 100/283; 100/293; 100/902; 220/735; 220/751

(58) Field of Classification Search ..... 100/218, 100/227, 280, 283, 293, 902, 258 A; D15/123; 220/669, 675, 908, 298, 735, 751
See application file for complete search history.

(56) References Cited

U.S. PATENT DOCUMENTS 4,301,722 A * 11/1981 Balbo et al. ..... 100/218
4,549,327 A * 10/1985 Johnson ..... 15/236.01
4,827,840 A * 5/1989 Kane ..... 100/280
4,962,701 A * 10/1990 Stralow ..... 100/215
5,048,413 A * 9/1991 Deiters ..... 100/226
5,179,893 A * 1/1993 Richardson ..... 100/98 R
5,203,262 A * 4/1993 Menard et al. ..... 100/233
5,778,773 A * 7/1998 Clark ..... 100/218
5,829,348 A * 11/1998 Morgan ..... 100/48
6,076,455 A 6/2000 Geise

* cited by examiner

*Primary Examiner*—Derris H. Banks
*Assistant Examiner*—Jimmy T. Nguyen
(74) *Attorney, Agent, or Firm*—Joseph S. Heino; Patrick M. Bergin

(57) ABSTRACT

An improved can compacting mechanism includes a can collection catch bin comprising a main catch bin body having integrally formed front wall, back wall, and opposing walls. Downwardly from the front, back and side walls, is a floor. The walls and floor are integrally formed into a single structure. Upwardly from the floor, the side walls are tapered inwardly towards a body neck and opening. The upper most portion of the front and back walls also terminate at the body neck and opening. The body neck is, in cross-section, a generally rectangular-shaped structure and the body opening is a generally rectangular-shaped aperture through which compacted cans are intent to pass as they drop by gravity from the can compacting mechanism of prior invention.

11 Claims, 4 Drawing Sheets

CAN COLLECTION CATCH BIN FOR USE WITH ALUMINUM CAN COMPACTING MECHANISM

This Application claims the benefit of U.S. Provisional Application No. 60/591,671, filed Jul. 28, 2004.

FIELD OF THE INVENTION

This invention relates generally to mechanisms for compacting objects and to accessory items for such mechanisms. More particularly, it relates to a can collection catch bin for use with an aluminum can compacting mechanism, which mechanism is manually actuated by a user and which uses gravity to discharge the compacted can from the mechanism and to collect the discharged can neatly within the catch bin. It also particularly relates to an improvement to a compacting mechanism of prior specific construction.

BACKGROUND OF THE INVENTION

In the experience of this inventor, the ability to recycle objects has become a necessity for the preservation of resources for our future generations. Recycling of virtually anything that can be recycled has become a way of life in our energy-conscious society. No less important in this regard is the lowly, but always present, aluminum can. The aluminum can is found virtually everywhere that beverages are sold or distributed. And, unfortunately, discarded aluminum cans are equally ready to find. Accordingly, a movement has been taking place to manufacture, distribute and sell aluminum can crushing and compacting mechanisms which can be readily purchased and used by the consuming public. One such mechanism is disclosed in this inventor's U.S. Pat. No. 6,076,455.

The inventor's prior aluminum can compacting mechanism, as disclosed and claimed in U.S. Pat. No. 6,076,455, is a relatively compact, wall-mountable, easy to use, and commercially available device. That device utilizes a can retaining means into which the user or consumer manually places the aluminum can which is intended to be compacted. A lever is actuated and the aluminum can is compacted between two compacting plates. In the can compacting mechanisms of the prior art, the lever is then reversed and the compacted can is manually removed from the device. Because this last step of this process can be an unpleasant one due to the presence of beverage residue which often accompanies such cans, and because it is a completely unnecessary step in his eyes, this inventor sought to eliminate it by construction of a device where the compacted can is automatically dropped from the device. That device is disclosed and claimed in U.S. Pat. No. 6,076,455.

Another result intended to be accomplished by the device disclosed in U.S. Pat. No. 6,076,455, is that the handle be stopped in its downward rotation so as to prevent pinch points within the device, a particularly important feature where the device is used by small children.

Although this device works well, what is needed is a convenient way to collect compacted cans as they are discharged from the aluminum can compacting mechanism as previously described. In particular, there is a need to provide a collection means that is conveniently and attractively located immediately beneath the subject can compacting mechanism. In the view of this inventor, the collection means should be functionally adapted to be removably attachable to the can compacting device of prior disclosure. This would ensure the inadvertent detachment of the collection means from the can compacting mechanism except where detachment was desired or required by the user. The collection means should be functionally adapted so as not to interfere with the operation of the prior can compacting mechanism, and particularly with regard to the full motion of the handle through its use cycle. The collection means should also be attractive in the accumulation, but not display, of unsightly compacted cans as they are collected. In this way, a can compacting mechanism that might otherwise be relegated to use in the garage, the basement, or some other location where it is generally out-of-sight, can be located in a kitchen, a utility room, or other area of a home or dwelling where it is more likely to be used than not. The collection means should also be self-contained and cleanable to collect and allow the removal of any residue that may otherwise escape from the compacted cans. In this way, the collection means can be dishwasher cleaned as such is desired or required. Finally, the collection means should come in a variety of sizes, depending upon the intended rate of accumulation as desired by the user.

Accordingly, it is an object of the present invention to provide a new and useful compacted can collection catch bin that can be easily used by a consumer with an aluminum can compacting mechanism of prior invention, which catch bin has a minimal number of parts and requires only a minimal number of steps to use. It is another object of the present invention to provide such a can collection catch bin that is conveniently locatable immediately beneath the aluminum can compacting mechanism of prior invention. It is yet another object of the present invention to provide such a can collection catch bin that is functionally adapted to be removably attachable to the can compacting device of prior invention. It is still another object of the present invention to provide such a can collection catch bin that includes means for preventing the inadvertent detachment of the catch bin from the can compacting mechanism except where detachment was desired or required by the user. It is a further object of the present invention to provide such a can collection catch bin that does not interfere with the operation of the prior can compacting mechanism, and particularly with regard to the full motion of the handle through its compression cycle. It is still another object of the present invention to provide such a can collection catch bin that is attractive in the accumulation, but not display, of unsightly compacted cans as they are collected so that the catch bin is more likely to be used in a kitchen or utility room setting rather than hidden away in a garage or basement. It is another object of the present invention to provide such a can collection catch bin that can be fabricated in a one-piece, unitary construction and be self-contained and cleanable to collect and allow the removal of any residue that may escape from the compacted cans. It is yet another object of the present invention to provide such a can collection catch bin that can be fabricated in a variety of sizes, depending upon the intended rate of accumulation as desired by the user, and be made to be dishwasher safe for occasional cleaning.

SUMMARY OF THE INVENTION

The can collection catch bin of the present invention has obtained these objects. It provides for a main collection catch bin body that is integrally formed of a front wall, a back wall and opposing sidewalls. The collection catch bin body is symmetrical about a central axis and unitary in construction. Downwardly from the front wall, back wall and side walls is a floor. In the preferred embodiment, the walls and floor are integrally formed into a single structure.

Upwardly from the floor, the side walls are tapered inwardly towards a body neck and opening. The uppermost portion of the front and back walls also terminate at the body neck and opening. The body neck is, in cross section, a generally rectangular-shaped structure and the body opening is a generally rectangular-shaped aperture located at the uppermost portion of the body neck and through which compacted cans are intended to pass as they drop by gravity from between the compression plates of the can compacting mechanism of prior invention. Additionally, the front wall includes a handle for conveniently grasping the catch bin by hand for removing it from the compacting mechanism of prior invention and allowing the user to empty its contents without requiring any direct contact with the compacted cans. The taper of and the presence of certain recesses defined within the neck of the catch bin body allow the can compacting mechanism of prior invention to operate through its full compression cycle without impediment and allows the compacted cans to pass through the neck without impingement. The uppermost portion of the catch bin neck also includes securement means comprised of opposing flanges which allow the catch bin to be easily and removably secured to the can compacting mechanism of prior invention. The securement means also includes a positive locking mechanism to prevent inadvertent detachment of the catch bin and provide the user with tactile or visual confirmation that the catch bin is secure in its proper position.

The foregoing and other features of the can collection catch bin of the present invention will be apparent from the detailed description that follows.

DETAILED DESCRIPTION

Figure 1:
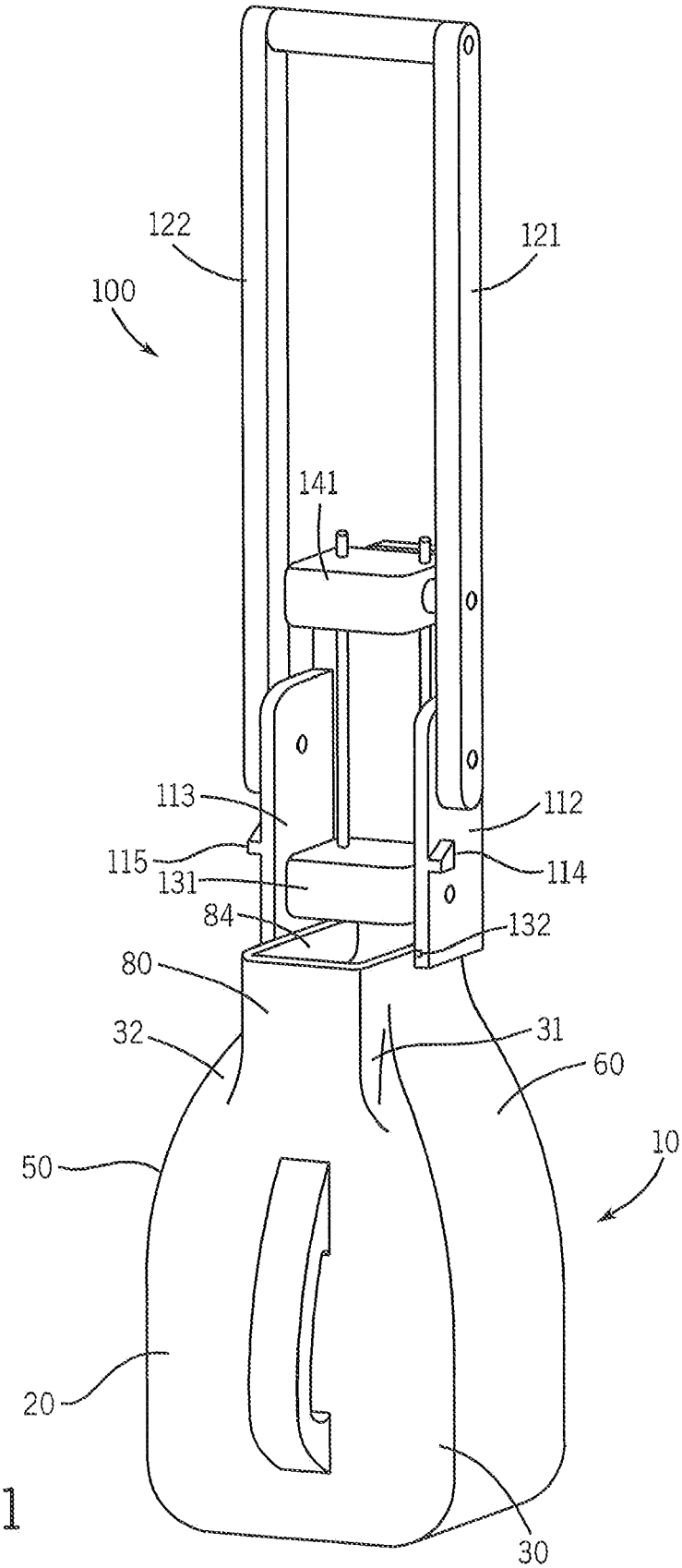
FIG. 1 is a front, top and right side perspective view of a can collection catch bin constructed in accordance with the present invention as it would be used when attached to a can compacting mechanism of prior invention.
Figure 5:
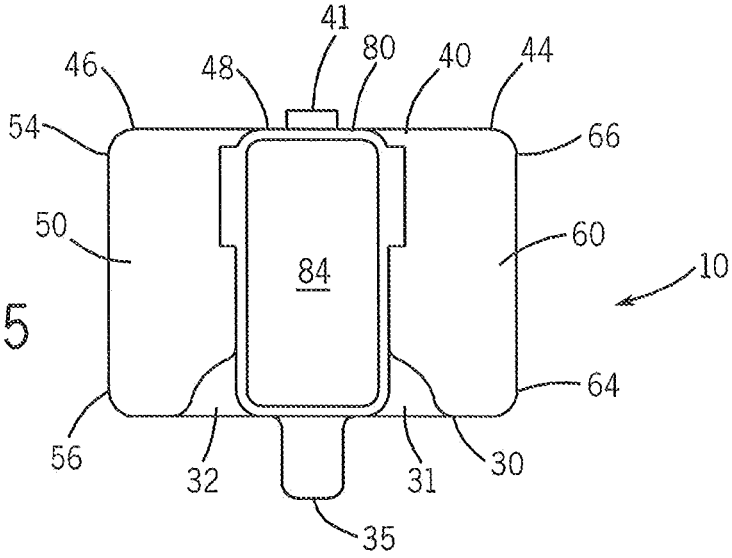
FIG. 5 is a slightly reduced top plan view of the can collection catch bin illustrated in FIG. 1.
Figure 6:
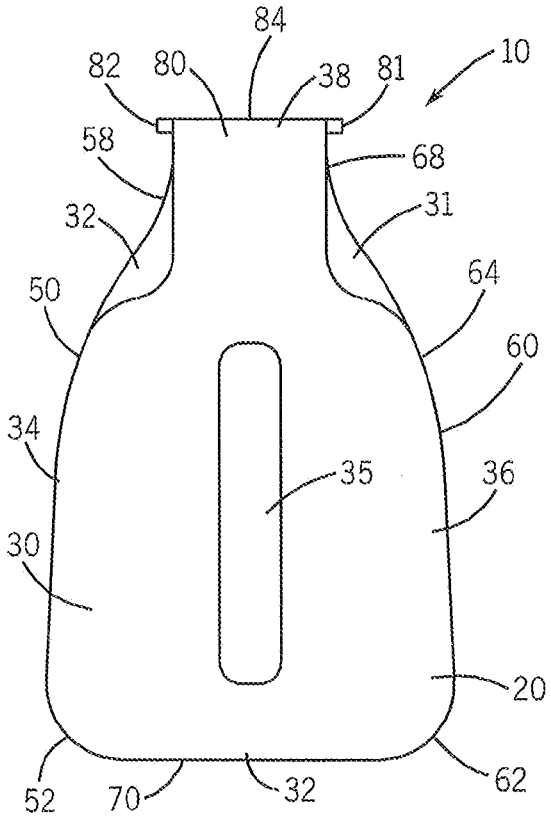
FIG. 6 is a slightly reduced front plan view of the can collection catch bin illustrated in FIG. 1.
Figure 7:
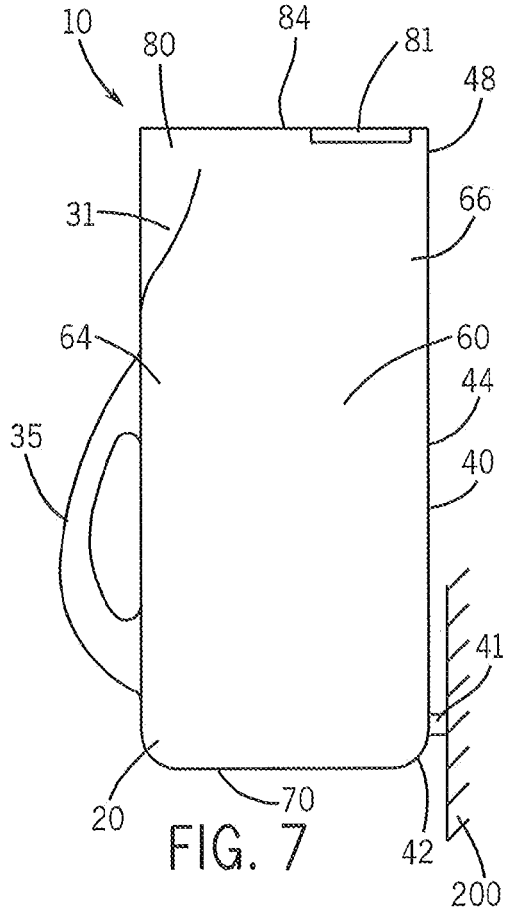
FIG. 7 is a slightly reduced right side elevational view of the can collection catch bin shown in FIG. 1.

Referring now to the drawings in detail wherein like numbers represent like elements throughout, FIG. 1 illustrates a can collection catch bin, generally identified 10, constructed in accordance with the present invention. As shown, the can collection catch bin 10 in the preferred embodiment is a generally hollow structure that is unitary in construction and includes an integrally formed main collection catch bin body 20 comprised of a front wall 30, a back wall 40 and a pair of opposing sidewalls 50, 60. See also FIGS. 5, 6 and 7. In the preferred embodiment, the main collection catch bin body 20 is also generally symmetrical about a central axis. Insofar as the unitary can collection catch bin 10 can be blow molded of a plastic material, this symmetry is desireable, but not required, but such symmetry and material of construction is not a limitation of the present invention.

The front wall 30 of the hollow catch bin body 20 includes a bottom edge 32, a pair of side edges 34, 36, and an upper portion 38. Similarly, the back wall 40 includes a bottom edge 42, a pair of side edges 44, 46, and an upper portion 48. See FIGS. 5 and 6.

The first side wall 50 includes a bottom edge 52, a pair of side edges 54, 56, and an upper portion 58. Similarly, the second side wall 60 includes a bottom edge 62, a pair of side edges 64, 66, and an upper portion 68. See FIGS. 5, 6 and 7.

The bottom edges 32, 42, 52, 62 of the front wall 30, back wall 40, and sidewalls 50, 60, respectively, also form the edges of a catch bin floor 70. As alluded to, in the unitary construction of the preferred embodiment, the walls 30, 40, 50, 60 and floor 70 are integrally formed into a single structure.

Figure 2:
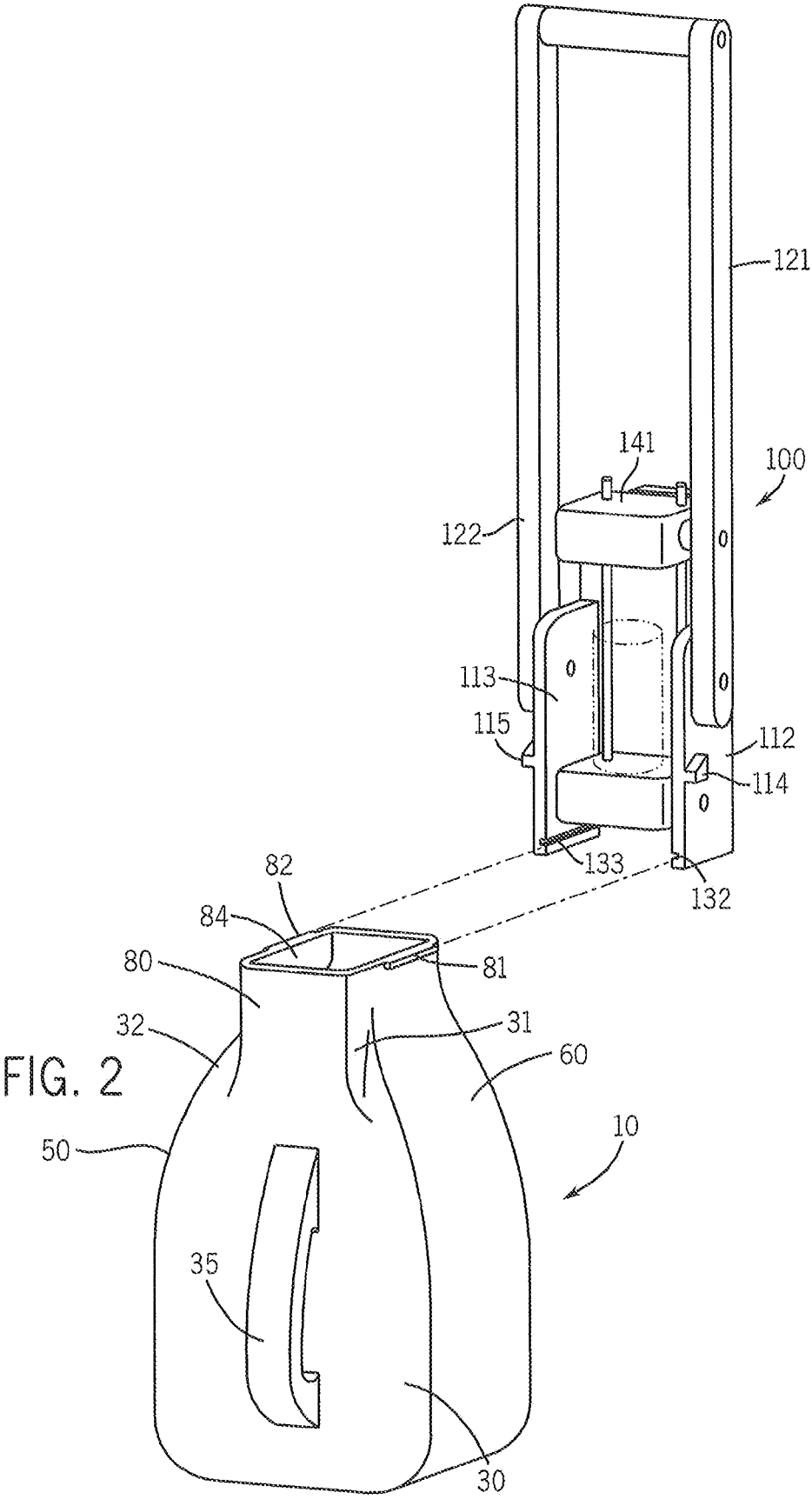
FIG. 2 is a slightly enlarged front, top and right side perspective view of a can collection bin constructed in accordance with the present invention and showing the catch bin detached from the can compacting mechanism.
Figure 3:
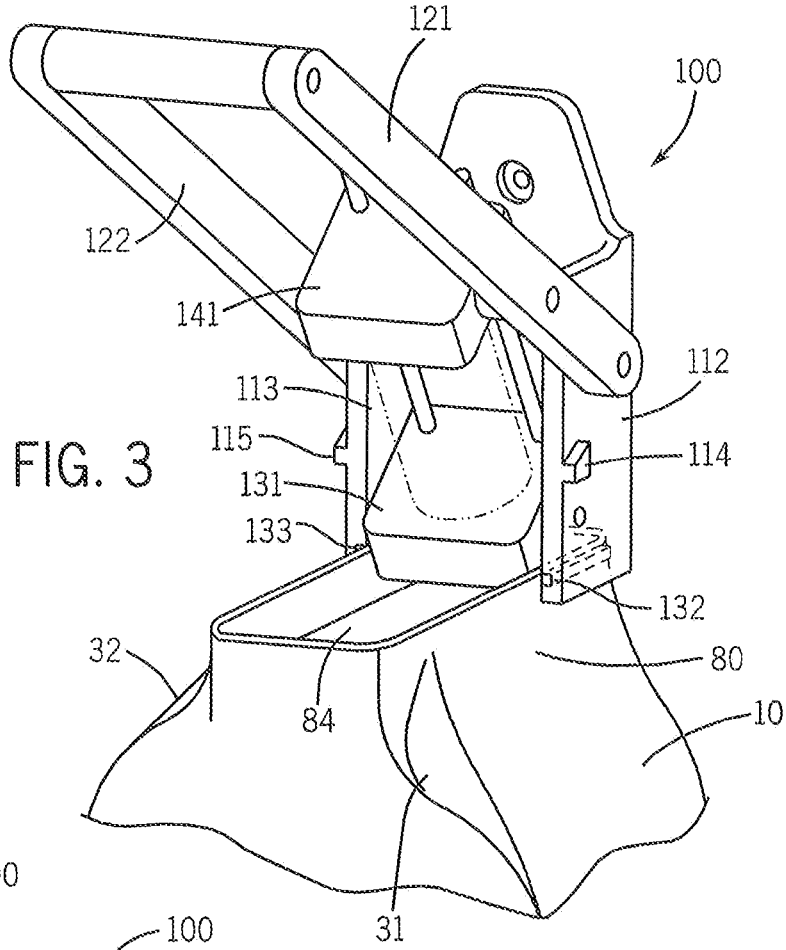
FIG. 3 is a partial view of the catch bin showing the neck and opening of the bin in a can-receiving relation to the compacting mechanism.

Towards the uppermost portion of the main collection catch bin body 20 is a catch bin neck 80. As shown in FIGS. 1, 2 and 3, it will be seen that the side walls 50, 60 are tapered inwardly towards the catch bin neck 80. In this fashion, the hollow can collection catch bin 10 is functionally adapted to be used with the can compacting mechanism 100 of prior invention. Refer again to FIG. 1. As shown, the catch bin neck 80 of the can collection catch bin 10 is functionally adapted to fit between the lowermost portion of the side support members 112, 113. It is to be understood that the inwardly-facing, opposing faces of each of the side support members 112, 113 include a generally horizontal groove or slot 132, 133 defined within them. See also FIG. 2. Each slot 132, 133 is functionally adapted to receive a flange 81, 82 that is situated to each wall side 50, 60 of the neck 80 of the can collection catch bin 10. In this fashion, the can collection catch bin 10 is slidably receivable within the lowermost portion of the can compacting mechanism 100 of prior invention. With this orientation, a can (shown in phantom view) that has been compacted between the compacting plates 131, 141 of the can compacting mechanism 100 of prior invention can, immediately following compaction, drop downwardly and into the can collection catch bin 10 via the catch bin neck 80. See FIG. 4. A number of such compacted cans can be accumulated before the catch bin 10 requires emptying. The size of the catch bin 10 is variable and size is not a limitation of the present invention. Thus, the catch bin 10 can be fabricated in a size to accommodate twenty four compacted cans, or more.

Significant in the configuration of the catch bin neck 80 of the hollow can collection catch bin 10 of the present invention is the fact that the neck 80 is, in cross section, a generally rectangular-shaped structure. Similarly, the body opening 84 situated at the uppermost portion of the neck 80 is a generally rectangular-shaped aperture and through which compacted cans are intended to pass as they drop by gravity from between the compacting plates 131, 141 of the can compacting mechanism 100 of prior invention. The taper of the catch bin body 20 near the uppermost portion of the front wall 30 creates a pair of recesses 31, 33 defined within the catch bin body 20 which allow the can compacting mechanism 100 of prior invention to operate through its full compression cycle without impediment. In the preferred embodiment, the neck 80 is configured of smooth and tapered lines to avoid any impingement of the compacted cans as they drop into the catch bin 10. See FIGS. 3 and 4. In operation, this allows longitudinally extending, parallel handle members 121, 122 of the can compacting mechanism 100 to move fully downwardly to the point that each contacts a stop member 114, 115, respectively, of the mechanism 100, but not the body 20 of the catch bin 10. Refer again to FIG. 4. The relatively smooth lines of the recesses 31, 33 prevent any obstacle to a compacted can passing through the neck 80.

In the preferred embodiment, the front wall 30 includes a handle 35 for convenient grasping of the catch bin 10 by hand for removing it from the compacting mechanism 100 of prior invention and allowing the user to empty its contents without requiring any direct contact with the compacted cans. See FIGS. 3 and 4. Similarly, the back wall 40 includes a stop member 41 for providing ancillary support of the catch bin 10 when the can compacting mechanism 100 is mounted to a generally vertical wall or other surface 200. See FIGS. 4 and 7. Use of the stop member 41 reduces any torsional force that may be exerted on the flanges 81, 82 as the catch bin 10 fills with compacted cans and the weight within the catch bin 10 increases.

Though not shown and not required for the purposes of disclosing enablement of the mechanism 100, the catch bin 10 could be configured with decorative or even seasonal themes to further encourage use of the mechanism 100 and its placement in a position of relatively high visibility. Such is not, however, a limitation of the present invention, but rather a logical extension of it.

In application, and referring again more particularly to FIG. 1, the user mounts the can compacting mechanism 100 in a location that is desired or required by the user. As alluded to earlier, it is intended that, by concealment of unsightly compacted cans within the catch bin 10, the combined unit can be mounted in a kitchen, utility room, or other area of the house without the need to conceal the unit in a basement or garage. This is accomplished by the elimination of an ad hoc container for holding the compacted cans in. Once located and mounted, the user inserts the catch bin 10 within the lowermost portion of the can compacting mechanism 100. This is accomplished by aligning the flanges 81, 82 of the catch bin 10 with the slots 132, 133, respectively, of the compacting mechanism 100. It is to be understood that other interlocking means could be used, or the slots 132, 133 could be defined within the catch bin 10 and the flanges 81, 82, or other securement means, could be defined within the compacting mechanism 100 without deviating from the scope of the present invention. It is also to be understood that the securement means could also include a positive locking mechanism to prevent inadvertent detachment of the catch bin and provide the user with tactile or visual confirmation that the catch bin is secure in its proper position. This could be accomplished by use of one or more cooperating bumps and corresponding recesses defined within the securement means.

Figure 4:
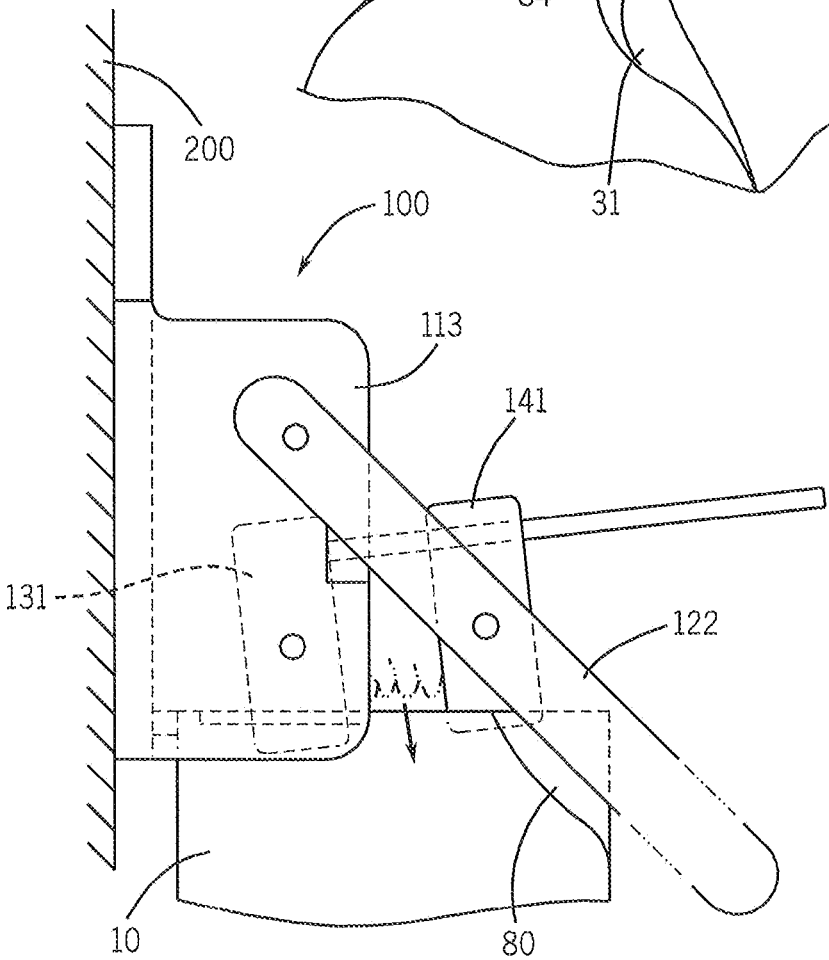
FIG. 4 is a left side elevational view of the catch bin neck and the compacting mechanism shown in FIG. 3 and illustrating the compacting mechanism in the fully-down handle compacting position.

The catch bin 10 is filled with compacted cans during repeated use of the mechanism 100. Any residue coming from the cans is contained within and is collected by the catch bin 10 and is unobservable by the user. As shown in FIGS. 3 and 4, the downward motion of the handle members 121, 122 of the can compacting mechanism 100 is not impeded due to the presence of the recesses 31, 33 to either side of the neck 80, which neck 80 contains an opening 84 in it for receiving compacted cans therethrough. The compacted cans (again, shown in phantom view) drop, without any encumbrance, into the catch bin 10 due to the smooth lines of the neck 80 and recesses 31, 33.

When the catch bin 10 becomes filled to the point that the user wishes to dispose of its contents, which may require a different number of compacted cans depending upon the size of the catch bin 10 desired or required by the user, the user grasps the handle 35 and pulls the catch bin 10 out and away from the wall or vertical surface 200 thereby releasing the flanges 81, 82 of the catch bin 10 from the slots 132, 133 of the compacting mechanism 100. See FIG. 2. The amount of force to be exerted by the user would also be sufficient to overcome the securement means or positive locking mechanism used in the device 100. The catch bin 10 is emptied and reinstalled as stated above. Occasionally, the catch bin 10 may be rinsed and cleaned, and may even be safely placed within a dishwasher for thorough cleaning, the catch bin 10 being constructed of dishwasher safe material in the preferred embodiment.

Based upon the foregoing, it will be seen that there has been provided a new and useful can collection catch bin of unitary construction that can be easily used by a consumer with an aluminum can compacting mechanism of prior invention, which catch bin has a minimal number of integrally formed parts and requires only a minimal number of steps to use; that is conveniently locatable immediately beneath the aluminum can compacting mechanism of prior invention; that is functionally adapted to be removably attachable to the can compacting device of prior invention; that includes means for preventing the inadvertent detachment of the catch bin from the can compacting mechanism except where detachment was desired or required by the user; that does not interfere with the operation of the prior can compacting mechanism, and particularly with regard to the full motion of the handle through its compression cycle; and that is attractive in the accumulation, but not display, of unsightly crushed cans as they are collected and that is self-contained and cleanable to collect and allow the removal of any residue that may escape from the crushed cans.

The invention claimed is:

1. For use with a can compacting mechanism, the mechanism comprising a pair of side support members, each side support member having a slot defined therein and a pair of cooperating compaction plates, said plates being movable towards one another to compact an upright can situated therebetween when a handle is rotated downwardly, a can collection catch bin which comprises a main catch bin body, said catch bin body including a front wall, a back wall, a first side wall and a second side wall, the first and second side walls generally opposing one another, and a floor, (i) the front wall including a bottom edge, a pair of side edges and an upper portion, (ii) the back wall including a bottom edge, a pair of side edges and an upper portion, (iii) the first side wall including a bottom edge, a pair of side edges and an upper portion, and (iv) the second side wall including a bottom edge, a pair of side edges and an upper portion, wherein the bottom edges of the front wall, the back wall and the first and second side walls, form the edges of the floor, the front wall upper portion, the back wall upper portion, and the side wall upper portions terminate in a generally rectangularly shaped neck having an upwardly facing aperture, each of the side wall upper portions further comprising a flange corresponding to the slot defined within each of the side support members for, removably attaching the catch bin body to the can compacting mechanism, the can compacting handle includes a pair of substantially parallel handle members and the neck of the catch bin includes a pair of recesses for accommodating a full downward movement of the handle members whereby compacted cans that drop from the mechanism are collected within the catch bin.

2. The catch bin of claim 1 wherein the catch bin is a generally hollow structure.

3. The catch bin of claim 1 wherein the front wall, the back wall, the opposing side walls, and the floor of the catch bin body are integrally formed.

4. The catch bin of claim 3 wherein the catch bin body is formed of a unitary plastic material.

5. The catch bin of claim 1 wherein the front wall includes a handle for holding the catch bin.

6. In an improved can compacting mechanism, the mechanism comprising a pair of side support members, each side support member having a slot defined therein and a pair of cooperating compaction plates, said plates being movable towards one another to compact an upright can situated therebetween when a handle is rotated downwardly, the improvement comprising a can collection catch bin, the catch bin having a generally rectangular shaped neck having an upwardly facing aperture, the neck having an upper front wall, an upper back wall and upper side walls, each of the the side upper walls having a flange, each of the flanges being removably insertable into each of the slots in each of side support members of the can compacting mechanism such that the catch bin removably attachable to the can compacting mechanism, wherein the handle includes a pair of substantially parallel handle members and the neck of the catch bin includes a pair of recesses for accommodating a full downward movement of the handle members.

7. The improved can compacting mechanism of claim 6 wherein the catch bin further comprises (a) a main catch bin body, said catch bin body including a front wall, a back wall, a first side wall and a second side wall, the first and second side walls generally opposing one another, and a floor, (i) the front wall including a bottom edge, a pair of side edges and an upper portion, (ii) the back wall including a bottom edge, a pair of side edges and an upper portion, (iii) the first side wall including a bottom edge, a pair of side edges and an upper portion, and (iv) the second side wall including a bottom edge, a pair of side edges and an upper portion, wherein the bottom edges of the front wall, the back wall and the first and second side walls, form the edges of the floor.

8. The improved can compacting mechanism of claim 7 wherein the catch bin is a generally hollow structure.

9. The improved can compacting mechanism of claim 7 wherein the front wall, the back wall, the opposing side walls, and the floor of the catch bin body are integrally formed.

10. The improved can compacting mechanism of claim 9 wherein the catch bin body is formed of a unitary plastic material.

11. The improved can compacting mechanism of claim 7 wherein the front wall of the catch bin includes a handle for holding the catch bin.

* * * * *